United States Patent [19]

Satake

[11] Patent Number: 4,727,990

[45] Date of Patent: Mar. 1, 1988

[54] AUTOMATIC CONTROL DEVICE FOR A BOUNDARY PLATE OF A GRAIN SEPARATOR

[75] Inventor: Toshihiko Satake, Higashihiroshima, Japan

[73] Assignee: Satake Engineering Co., Ltd., Tokyo, Japan

[21] Appl. No.: 188,369

[22] Filed: Sep. 18, 1980

[30] Foreign Application Priority Data

Sep. 22, 1979 [JP] Japan ..... 54-131568
Jan. 12, 1980 [JP] Japan ..... 55-2476

[51] Int. Cl.[4] ..... B07B 13/10; B07B 13/16

[52] U.S. Cl. ..... 209/557; 209/576; 209/694

[58] Field of Search ..... 209/45, 552, 557, 576, 209/577, 578, 580, 581, 587, 588, 635, 691, 694, 696, 700, 707

[56] References Cited

U.S. PATENT DOCUMENTS 3,807,554 4/1974 Satake ..... 209/694
3,933,249 1/1976 Welsh et al. ..... 209/694 X
4,301,931 11/1981 Satake ..... 209/691

FOREIGN PATENT DOCUMENTS 53-92274 7/1978 Japan .
54-129567 10/1979 Japan ..... 209/691
1012436 12/1965 United Kingdom ..... 209/694

*Primary Examiner*—Robert B. Reeves

*Assistant Examiner*—Edward M. Wacrya

*Attorney, Agent, or Firm*—Henry Sternberg; Bert J. Lewen

[57] ABSTRACT

An automatic control device for a boundary plate of a grain separator for separating a grain mixture into different grains. The grain separator has a separator plate provided with a roughened surface and mounted at inclinations in both of longitudinal and lateral directions with respect to the horizontal plane. A lateral movement is imparted to the different grains on the separator plate by a lateral oscillation given to the separator plate or by a lateral jet of air jetted from a numerous small aperture formed in the separator plate, so that the flow fluxes of different grains are deflected away from each other due to the difference in the physical properties such as specific weight and/or friction coefficient, so that the mixture of different grains are separated. The automatic control device comprises a photoelectric detector associated with a boundary plate and disposed in a grain transfer trough provided at the downstream end of the separator plate and having a light transmitting surface disposed substantially vertically on the wall of a grain flow sleeve mounted in the grain transfer trough so that the light transmitting surface is continuously cleaned by the grains which make sliding contact with the light transmitting surface, thereby to ensure an accurate measurement of the mixing ratio of grain mixture and, accordingly, a correct automatic adjustment of position of the boundary plate in the grain transfer trough.

2 Claims, 7 Drawing Figures

AUTOMATIC CONTROL DEVICE FOR A BOUNDARY PLATE OF A GRAIN SEPARATOR

The present invention relates to an automatic control device for a boundary plate of a grain separator.

Such an oscillation type grain separator has been known hitherto as having a separator plate having a roughened surface inclined in both of longitudinal and lateral directions with respect to the horizontal plane, the separator plate being adapted to be oscillated at an oscillation angle greater than the lateral inclination angle. As a mixture of different grains, e.g. hulled or brown rice and unhulled rice, is supplied to the separator plate at the lateral higher portion of the longitudinal higher side of the latter, the flows of these two grains are deflected due to the difference of physical properties, i.e. the difference in coefficient of friction and specific weight, such that the brown rice is concentrated to the lateral higher side whereas the unhulled rice is concentrated to the lateral lower side. The flow flux of the mixture grain is made to flow between the flow flux of the brown rice and the flow flux of the unhulled rice from the longitudinal higher side toward the longitudinal lower side so that the grain mixture is continuously separated into the brown rice grain and unhulled rice grain. The separated grains are made to drop into a grain transfer trough provided at the longitudinal lower end of the separator plate.

In such a type of grain separator, it has been known as shown in Japanese Utility Model Laid-Open No. 92274/1978 to provide boundary plates in the trough and to manually shift these boundary plates along the trough in accordance with the variation of the width of the separated grain fluxes.

A grain separator of another type which operates in a manner similar to that of the oscillation type grain separator and comprising a separator plate having a roughned surface and mounted at inclination in both of longitudinal and lateral directions, the separator plate being provided with a numerous small apertures directed obliquely upwardly so as to be able to discharge an air jet toward the lateral higher side of the separator plate, an air chamber disposed beneath the separator plate and adapted to supply the apertures with air, a grain transfer trough provided at the longitudinal lower end of the separator plate, and manually operable boundary plates arranged in said trough, has also been known.

In these known grain separators, the operator thereof must monitor variations in the flow of the grains flowing down the separator plate and must adjust the position of the boundary plates in the grain transfer trough in response to the variation and therefore the known grain separators are disadvantageous in that the operation thereof is troublesome.

Under these circumstances, the present invention aims at providing an automatic control device for a boundary plate of a grain separator of the described type.

In accordance with the present invention, there is provided an automatic control device for a boundary plate of a grain separator comprising a separator plate provided with a roughened surface and mounted at inclinations in both of longitudinal and lateral directions with respect to the horizontal plane, means for supplying a mixture of different grains to the lateral higher portion of the longitudinal higher side of the separator plate, means for imparting lateral movement to the grains on said separator plate, and a grain transfer trough provided with boundary plates and mounted at the longitudinal lower end of the separator plate, wherein the flow flux of one of the different grains is deflected to the lateral higher side of said separator plate while the flow flux of the other grains is deflected to the lateral lower side of said separator plate by said lateral movement imparted to said grains, due to the difference in physical properties beteen said different grains, while the flow flux of grain mixture moves from the longitudinal higher side to the longitudinal lower side of the separator plate through the area between said flow fluxes of said different grains, said fluxes being separated from one another by said boundary plates as said fluxes drop into and flow through said grain transfer trough, characterized in that said automatic control device comprising a photoelectric detector disposed at an area in said grain transfer trough near the boundary between one of the fluxes of different grains and said flux of grain mixture, in such a manner that the light transmitting surface of said photoelectric detector is disposed substantially vertically so that one of said boundary plates associated with said photoelectric detector is moved and adjusted in accordance with the result of detection of the light reflected by or transmitted through the grains flowing through said area, while said light transmitting surface of said photoelectric detector being continuously contacted slidingly by the grains flowing through said area.

In accordance with the present invention, there is also provided an automatic control device of the kind as stated above wherein said means for imparting lateral movement to said grains include an oscillation device disposed beneath said separator plate and adapted to laterally oscillate said separator plate at an oscillation angle greater than the lateral inclination angle of said separator plate.

In accordance with the present invention, there is further provided an automatic control device of the first mentioned type wherein said means for imparting lateral movement to said grains include an air chamber provided under said separator plate, means for intermittently supplying said air chamber with air and a numerous small apertures formed in said separator plate in such a manner as to be able to direct jets of air supplied from said air chamber, obliquely upwardly toward the lateral higher side of said separator plate.

In accordance with the invention there is still further provided an automatic control device of the first mentioned type wherein said photoelectric detector is mechanically connected to said associated boundary plate and is also electrically connected to a reversible electric motor for shifting the position of said associated boundary plate, through the medium of a controller.

According to the invention, the boundary plate is accurately and automatically controlled by the associated photoelectric detector to ensure the discharge of completely separated grains at a high yield.

The foregoing and still other advantages of the invention will be made more apparent from the following detailed explanation of the preferred embodiments of the invention in conjunction with the accompanying drawings wherein.

Figure 1:
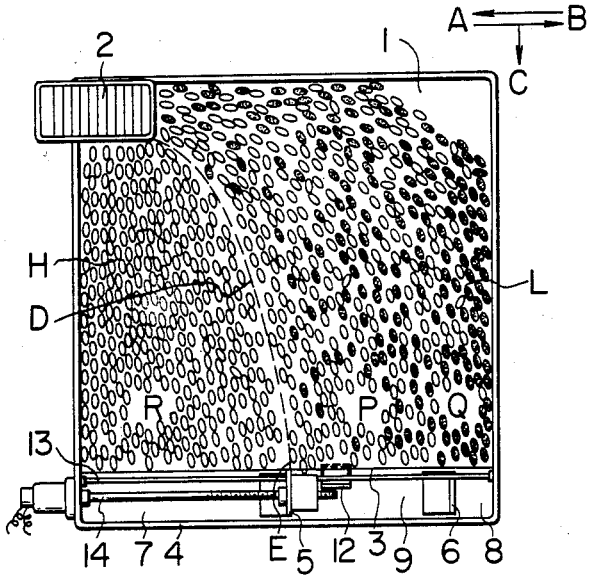
FIG. 1 is a plan view of a separator plate of an embodiment of the invention.

Referring to the drawings, a reference numeral 1 denotes a separator plate provided with a roughened surface which provides a friction resistance against the flow of grains. The separator plate is mounted at an inclination in both of longitudinal and lateral directions with respect to the horizontal plane. An oscillation device (not shown) mounted beneath the separator plate 1 imparts an oscillation to the separator plate 1, in the direction of arrow A-B in FIG. 1, at an oscillation angle greater than the lateral inclination angle shown in FIG. 2. A feeding device 2 provided at the lateral higher portion of the longitudinal higher side of the separator plate 1 is adapted to feed a mixture of different grains such as brown rice grain and unhulled rice grain. As this mixture is fed to the separator plate, the flow of the brown rice grain and the flow of the unhulled rice grain are respectively concentrated to the lateral higher side (H) and lateral lower side (L) due to the difference in physical properties, i.e. friction coefficient and specific weight, partly because of the friction imparted by the roughened surface and partly because of the oscillation of the separator plate, as the flow of the mixture grain moves from the longitudinal higher side (upper side of FIG. 1) to the longitudinal lower side (lower side of FIG. 1) as represented by an arrow C. Thus, the flow flux (R) of the brown rice grains and the flow flux (Q) of the unhulled rice grain are separated from each other with the flow flux (P) of the grain mixture flowing between these two fluxes (R) and (P). The grains then drop into a grain transfer trough 4 disposed at the longitudinal lower end 3 of the separator plate, and the grains of brown rice, grains of unhulled rice and the mixture grains are separately introduced into respective discharge passages 7, 8, 9 by means of boundary plates 5, 6 which are adjustable along the end 3 of the separator plate. As in the case of conventional grain separator of the kind described, this grain separator is provided with means (not shown) for adjusting the lateral inclination of the separator plate in accordance with the nature of the grains to be separated, so that the lateral inclination of the separator plate is adjustable to permit the flow fluxes of the grains to flow over the entire area of the separator plate as shown in FIG. 1.

Figure 3:
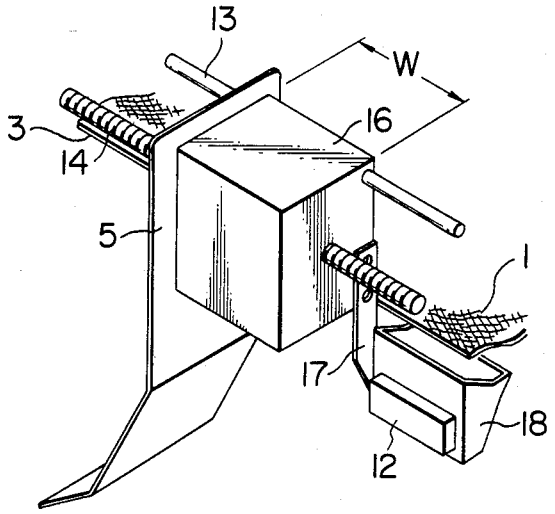
FIG. 3 is an enlarged perspective view of an essential part of the trough shown in FIG. 2.
Figure 4:
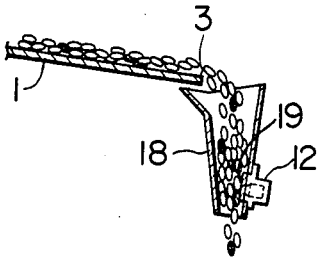
FIG. 4 is a sectional view of a grain flow sleeve.
Figure 5:
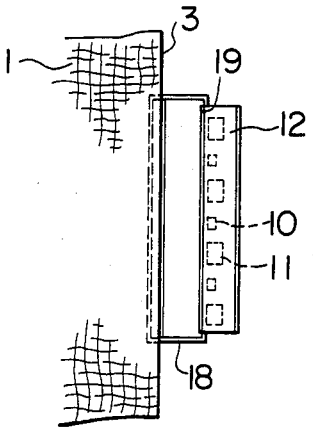
FIG. 5 is a plan view of the grain flow sleeve.

At the area (E) where the grains constituting the boundary (D) of the flow flux (P) of the mixture grains and the flow flux (R) of the brown rice at the lateral higher side (H) flow, provided is a photoelectric grains detector 12 constituted by a plurality of light sources 10 such as light-emitting diodes and a plurality of light-receiving elements 11 such as photoelectric cells adapted to receive the light emitted from the light sources and reflected by the grains, so as to detect the amount of the light reflected by the grains flowing through the aforementioned area (E). The photoelectric detector 12 is connected to the boundary plate 5 with a suitable correction space (W) therebetween as shown in FIG. 3. The boundary plate 5 is mounted slidably on a guide rail 13 and is connected to a reversible electric motor 15 through a screw shaft 14. The motor 15 in turn is connected through a controller 16 to the photoelectric detector 12.

Figure 2:
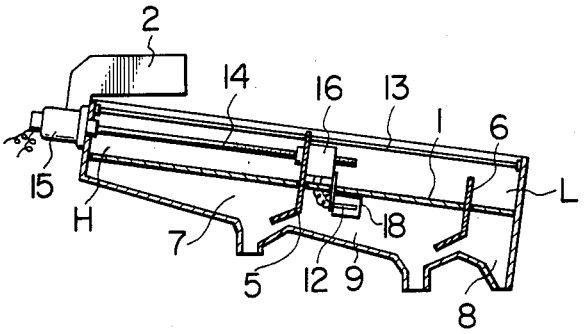
FIG. 2 is a sectional view of a grain transfer trough attached to the separator plate as shown in FIG. 1.

As will be seen from FIG. 1, the rate of mixing of the unhulled rice (shown as dotted grains in FIG. 1) to the flow flux (P) of the grain mixture is gradually decreased as the flow flux (R) of the brown rice shown as white or black grains) is approached. The photoelectric detector 12 is not mounted at the area where almost all of the grains are brown rice grains but at such a base point that the flow flux (P) of the grain mixture contains small amount, e.g. 3 to 5%, of the unhulled rice grains.

As the photoelectric detector 12 detects a mixing rate (amount of light) in excess of the abovementioned value, the controller 16 provides a signal for forwardly driving the motor 15 so that the photoelectric detector 12 is moved toward the flow flux (R) of the brown rice through the forward rotation of the screw shaft 14.

To the contrary, if the photoelectric detector 12 has been moved excessively toward the flux (R) of the brown rice grains, the screw shaft 14 is rotated in the backward direction to move the photoelectric detector 12 toward the flow flux (P) of the grain mixture. Thus, the detector 12 is automatically adjusted until it is set at the aforementioned base point. A stable position of the boundary plate 5 is determined by this repetitional adjusting operation of the detector 12. Thus, the boundary plate 5 is located at a position which is spaced by a suitable correction distance (W) from the position of the photoelectric detector 12 located at the base point, i.e. at a slight offset from the base point toward the flow flux (R) of the brown rice grains.

As mentioned before, the unhulled rice grain content, which is about 3 to 5% at the base point, is gradually reduced toward the flow flux (R) of the brown rice grains and is finally reduced to zero where the perfect flow flux (R) of the brown rice grains is formed. The correction distance (W) is so selected as to be sufficient for reducing the mixing ratio from 3 to 5% down to zero, i.e. to ensure the positioning of the boundary plate 5 always in the flow flux (R) of the brown rice grains.

In the described embodiment, the photoelectric detector is fixed to the boundary plate 5 with the frame of the controller 16 incorporating the detection and control circuit located at the position of the correction distance (W) in the grain transfer trough 4. A grain flow sleeve 18 having the form of a hollow box is suspended from an attaching rod 17 secured to one side of the frame of the controller. The photoelectric detector 12 is fixed to the outer side of the grain flow sleeve 18 such that the light transmitting surface 19 of the photoelectric detector 12 is positioned on the substantially vertical wall of the grain flow sleeve. Both of the boundary plate 5 and the photoelectric detector 12 are under control of the detection signal of the controller 16 which interconnects the light receiving element 11 of the photoelectric detector 12 and the reversible electric motor 15.

In the described embodiment, the arrangement is such that the light sources 10 and the light receiving elements 11 of the photoelectric detector 12 are disposed on the same side wall of the grain flow sleeve so that the light emitted from the light source is reflected by the flux of flow of grains and received by the light receiving element. This arrangement, needless to say, is not exclusive and the arrangement may be such that the light transmitted from the light sources provided on one side wall of the grain flow sleeve is received by the light receiving elements disposed on the other side wall of the same, across the flux of flow of the grains.

In the described embodiment, the photoelectric detector is disposed in the area of the transfer trough near the boundary between the flow flux of the brown rice grain, which is concentrated to the lateral higher side of the separator plate, and the flow flux of the mixture grain. However, the photoelectric detector may be located at the lateral lower side of the separator plate. i.e, in the area where the boundary between the flow flux of unhulled rice grains and the flow flux of grain mixture is formed in the described embodiment, so as to adjust the position of the other boundary plate.

To sum up, in the described embodiment, the photoelectric detector is positioned in the area within the grain transfer trough provided at the end of the separator plate, near the boundary between a flow flux of grains and the flow flux of grain mixture, in such a manner that the light transmitting surface of the photoelectric detector is disposed substantially vertically so as to detect the amount of light reflected by or transmitted through the grains flowing through that area, so that the light transmitting surface of the photoelectric detector is continuously contacted slidingly by the grains and cleaned by the latter.

Therefore, the light transmitting surface is always kept clean to ensure a highly accurate and stable measurement of the mixing rate of the grains, i.e. the amount of light. Thus, even when the position of the boundary between the flow flux of grains and the flow flux of the mixture grains is fluctuated during the operation of the grain separator, the photoelectric detector detects such a fluctuation without delay and promptly shifts the boundary plate to correctly regulate the flowing width of the discharge opening to ensure the discharge of completely separated grains at a high yield.

Figure 6:
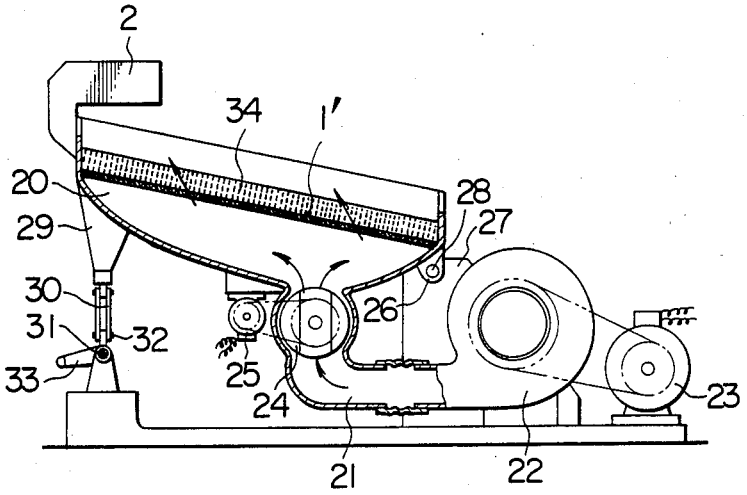
FIG. 6 is a sectional side elevational view of the grain separator of another embodiment of the invention.

Referring now to FIG. 6 which is a side elevational view of another embodiment of the invention, a separator plate 1′ also is provided with a roughened surface and is mounted at inclinations in both of longitudinal and lateral directions. In this embodiment, an air chamber 20 is disposed under the separator plate 1′ and fixed to the latter. The air chamber 20 is connected to a blower 22 through an air passage 21. A reference numeral 23 denotes an electric motor adapted to drive the blower through a belt and pulleys. A rotary valve 24 is disposed at a portion of the air passage 21 adjacent to the air chamber 20, and is adapted to be rotatively driven through a belt and pulleys by an electric motor 25 disposed beneath the air chamber 20, so that the air forcibly supplied by the blower is intermittently introduced into the air chamber 20.

Tabs 26 are formed at both ends of lateral lower side of the separator plate 1′ to extend downwardly therefrom, and are pivotally carried by a pivot shaft 28 horizontally mounted on a base 27. A downwardly projecting supporting lever 29 extends downwardly from each end of the lateral higher side of the separator plate 1′. Two support rods 30 are pivotally connected at their upper ends to both sides of the lower end of the supporting rod 29. A screw shaft 31 horizontally carried by the base 27 has threaded portions on which threads are formed in opposite directions starting from the central portion of the screw rod toward respective ends of the same. The support rods 30 are pivotally connected at their lower ends to a nut 32 engaging one of the threaded portions of the screw shaft. The arrangement is such that the nuts 32 on the opposite threaded portions of the screw rod are moved toward and away from each other as a handle 33 fixed to one end of the screw shaft 31 is rotated, so that the inclinations of the support rods 30 connected to the nuts are changed by an equal amount. As a result, the supporting levers 29 of both ends of lateral higher sides of the separator plate are displaced in the vertical direction by an equal amount, so that the lateral inclination of the separator plate is adjusted.

Figure 7:
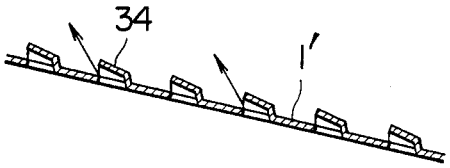
FIG. 7 is an enlarged sectional view of a part of a separator plate incorporated in the grain separator shown in FIG. 6.

The separator plate 1′ is provided with numerous small apertures 34 formed therein in such a manner as to be able to direct the flow of air coming from the air chamber obliquely upwardly toward the lateral higher side of the separator plate as indicated by an arrow in FIG. 6. Examples of such small apertures 34 are shown at FIG. 7.

In the embodiment shown in FIG. 6, a grain transfer trough similar to that of the first embodiment is provided at the longitudinal lower side of the separator plate 1′. As in the case of the first embodiment, this grain transfer trough has discharge passages for the brown rice grains, mixture grains and the unhulled rice grains defined by two boundary plates. Other members or parts, such as photoelectric detector, guide rail, screw shaft, reversible motor, controller, grain flow sleeve and the light transmitting wall of the grain flow sleeve are not described here because they are constructed and arranged in the same manner as the first embodiment.

In operation of the grain separator as shown in FIG. 6, as the electric motors 23, 25 are started while a mixture of different grains, mixture of brown rice grains and unhulled grains in this case, is supplied to the separator plate 1′ from the feeding device 2, the air forcibly fed by the blower 22 is intermittently introduced into the air chamber 20 due to the action of the rotary valve 24. The air is then intermittently discharged through the small apertures 34 in the separator plate 1′ obliquely upwardly and toward the lateral higher side of the separator plate as indicated by the arrow, so that the layer of flowing grain mixture is floated above the top surface of the separator plate in a wavelike manner continuously, so that two grains are separated from each other due to the difference in physical properties. More specifically, as in the case of the first embodiment shown in FIG. 1, the flow of the brown rice grains of larger specific weight is concentrated to the lateral higher side of the separator plate, while the flow of the unhulled grains of smaller specific weight is deflected toward the lateral lower side of the separator plate, as the grain mixture flows from the longitudinal higher side to the longitudinal lower side of the separator plate, so that grains are discharged into the grain transfer trough from the end of the separator plate 1′, in the form of three flow fluxes, namely the flow flux of brown rice grains, flow flux of grain mixture and the flow flux of the unhulled rice grains. The lateral inclination of the separator plate 1′ is adjusted by means of the handle 33 in accordance with the nature of the different grains to be separated, such that the fluxes of the grains cover and spread over the entire area of the separator plate 1′ in this state, as in the case of the first embodiment shown in FIG. 1 and fixed in the adjusted lateral inclination.

Thereafter, the boundary plate is automatically controlled in accordance with the result of detection of mixing rate by the photoelectric detector so as to correctly regulate the width of the discharge opening for the grain flow flux (flux of flow of brown rice grains in this case).

What is claimed is:

1. An automatic control device for a boundary plate of a grain separator comprising a separator plate provided with a roughened surface and mounted at inclinations in both of longitudinal and lateral directions with respect to the horizontal plane, means for supplying a mixture of different grains to the lateral higher portion of the longitudinal higher side of the separator plate, means for imparting lateral movement to the grains on said separator plate, and a grain transfer trough provided with boundary plates and mounted at the longitudinal lower end of the separator plate, wherein the flow flux of one of the different grains is deflected to the lateral higher side of said separator plate while the flow flux of the other grains is deflected to the lateral lower side of said separator plate by said lateral movement imparted to said grains, due to the difference in physical properties between said different grains, while the flow flux of grains mixture moves from the longitudinal higher side to the logitudinal lower side of the separator plate through the area between said flow fluxes of said different grains, said fluxes being separated from one another by said boundary plates as said fluxes drop into and flow through said grain transfer trough, characterized in that said automatic control device comprises a photoelectric detector disposed at an area in said grain transfer trough near the boundary between one of the fluxes of different grains and said flux of grain mixture, in such a manner that the light transmitting surface of said photoelectric detector is disposed substantially vertically so that one of said boundary plates associated with said photoelectric detector is moved and adjusted in accordance with the result of detection of the light reflected by or transmitted through the grains flowing through said area, while said light transmitting surface of said photoelectric detector is continuously contacted slidingly by the grains flowing through said area, wherein said light-transmitting surface of said photoelectric detector is disposed on the wall of a grain flow sleeve mounted in said grain transfer trough and wherein said grain flow sleeve on which said photoelectric detector is disposed is spaced at a slight offset distance from said one of said boundary plates.

2. An automatic control device as claimed in claim 1, wherein said photoelectric detector is mechanically connected to said associated boundary plate and is also electrically connected to a reversible electric motor for shifting the position of said associated boundary plate, through the medium of a controller.

* * * * *